United States Patent [19]

Paisley

[11] 4,102,089

[45] Jul. 25, 1978

[54] PARTITION STRUCTURE

[76] Inventor: John C. Paisley, Rte. 1, Box 4A, Orange, Va. 22960

[21] Appl. No.: 771,765

[22] Filed: Feb. 24, 1977

Related U.S. Application Data

[63] Continuation-in-part of Ser. No. 723,894, Sep. 16, 1976, Pat. No. 4,038,790.

[51] Int. Cl.[2] ..... E04B 2/82

[52] U.S. Cl. ..... 52/36; 52/238; 211/134; 211/187; 248/243

[58] Field of Search ..... 52/36, 238, 241, 243, 52/481, 720; 211/134, 148, 176; 108/108; 248/218, 221, 240, 243

[56] References Cited

U.S. PATENT DOCUMENTS

| | | | |
|---|---|---|---|
| 2,233,719 | 3/1941 | Vanderveld | 52/36 X |
| 2,971,805 | 2/1961 | Weiss | 52/36 X |
| 3,025,971 | 3/1962 | McLean | 211/176 |
| 3,482,706 | 12/1969 | Stewart | 52/36 |
| 3,713,257 | 1/1973 | Beavers | 52/36 |
| 3,908,320 | 9/1975 | Hogue | 52/36 |

*Primary Examiner*—J. Karl Bell
*Attorney, Agent, or Firm*—Lee C. Robinson, Jr.

[57] ABSTRACT

A partition structure includes a support post having a plurality of vertical sides and a partition panel secured to one of these sides, with the panel having an edge portion located in parallel closely spaced alignment with one of the sides of the post to define a thin cavity therebetween. An elongated bracket support strip is located in the cavity and secured to the adjacent side of the post. This strip has a plurality of vertically spaced embossments of predetermined configuration formed thereon extending outwardly of the post side towards the edge portion of the adjacent panel. A support bracket having an inner edge portion including a plurality of spaced mounting tabs formed thereon, with the mounting tabs being spaced from each other at regular intervals selected to enter the cavity between said embossments, has edge configurations formed on the tabs to mate with at least a portion of the predetermined configuration of the embossments, thereby to support the bracket on the post.

12 Claims, 7 Drawing Figures

FIG.3
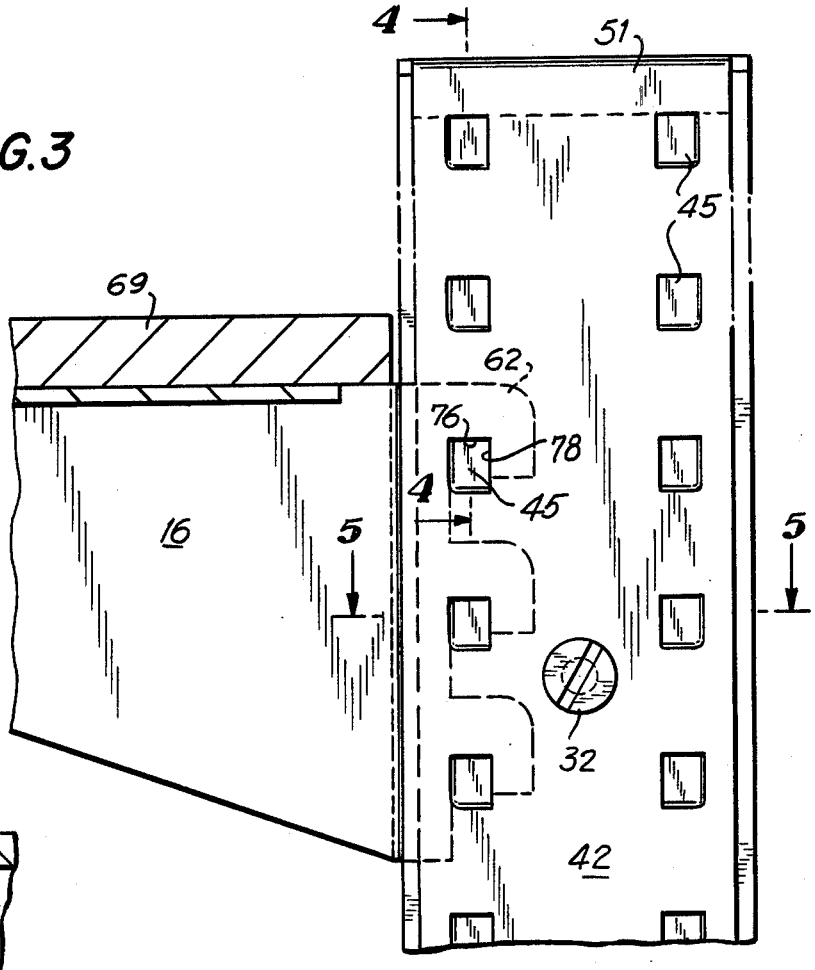
FIG.4
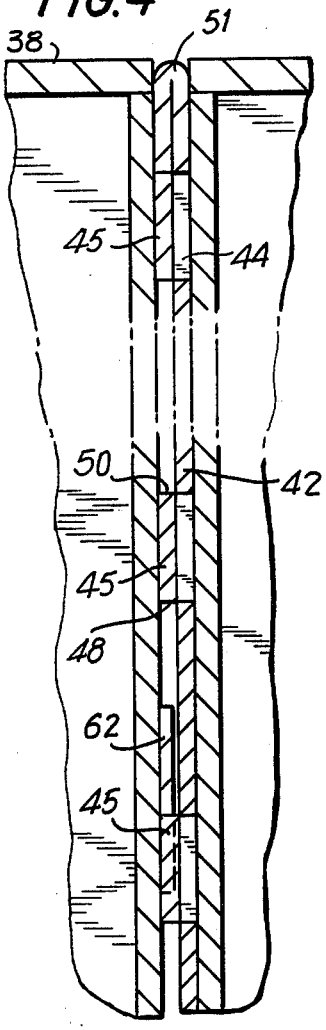
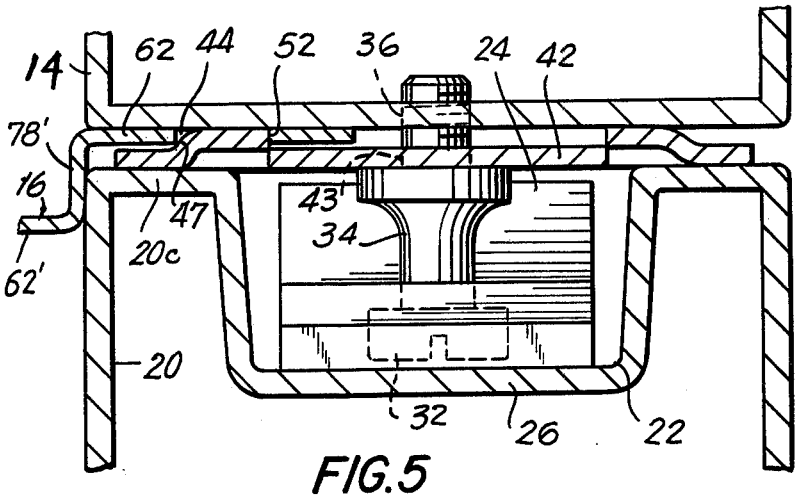
FIG.5

PARTITION STRUCTURE

This application is a continuation-in-part of U.S. patent application Ser. No. 723,894 filed Sep. 16, 1976 now Pat. No. 4,038,790, the disclosure of which is incorporated herein by reference.

The present invention relates to partition constructions, and more particularly, to a partition structure for supporting a cabinet, shelf or other wall element.

Movable interior partition structures dividing building spaces in offices, schools and the like have been used and accepted in the construction industry in order to permit flexible designs for building spaces. Such structures are usually manufactured from sheet metal and are relatively simple to erect and disassemble. Such structures usually are spray coated or painted with the desired color in an at least partially assembled position. The preferred type of partition structure provides a flush construction having a uniform and pleasing appearance with no overlapping or protruding parts that would tend to reduce the amount of usable floor space.

Numerous systems for partition constructions have previously been proposed, but in most such systems it is often difficult to conveniently mount hanging cabinets, shelves, or the like on the partition panel so that they fit properly across the panels and particularly into the inside corners between angularly related wall panels without defacing the panels themselves.

The typical partition structure includes vertical support posts and panels secured to the posts. Where provision is made for mounting cabinets or shelves on the posts, or the post supports between the panels, the posts are provided with a structural arrangement which allows shelf brackets to be mounted thereon. One disadvantage of the prior arrangements for this purpose is that it often is difficult for a series of shelves or cabinets to be mounted on adjacent panels at the same elevation since each support post permits the mounting of only one bracket. Accordingly while a single shelf or cabinet could be mounted on one wall panel, no provision is made for a second bracket to permit mounting an additional adjacent shelf at the same level. Accordingly a substantial amount of space suitable for use in providing shelf or cabinet space is wasted. Moreover, with such previously proposed systems, the posts themselves were usually constructed so that the mounting arrangement for the brackets was located within the post, thus eliminating the post as a conduit for electrical connections and wires.

One solution for the problem of previously proposed partition structures which overcomes the above noted disadvantages is disclosed in U.S. Pat. No. 3,921,347. In that patent a support strip bracket is located in the cavity between at least one side of a hollow vertical support post and a bent flange on the wall panel. This strip has a configuration adapted to receive complementary tabs formed on a shelf bracket or the like. With this arrangement adjacent shelves can be mounted on adjacent wall panels and the post itself is left free to serve as an electrical conduit or chase. However, with that strip arrangement the interrupted front edge of the strip gets painted during the spray painting operation and those painted portions of the strip contrast with the inner edges of the recesses on the strip which are not reached in the spray painting operation. Thus in the completed product it often appears that portions of the internal supporting strip are unpainted, with the result that when the completed panel is viewed straight on, a series of unpainted areas appear in the cavity between the post and panel. This may or may not be considered aesthetically satisfactory by particular purchasers.

These problems, and other are solved by the invention of the above mentioned patent application which allows elimination of the strip and provides for the formation of bracket mounting embossments on one side of the support post. However such an arrangement is primarily useful with heavy gauge (e.g. 14 gauge) posts and cannot be used as advantageously with lighter gauge (e.g. 16 gauge) posts.

It is an object of the present invention to provide a partition structure which is relatively simple in construction and easy to manufacture while permitting convenient mounting of cabinet and shelf brackets thereon.

Another object of the present invention is to provide a partition structure which permits mounting of cabinet and shelf brackets with a neat appearance on a flush partition wall.

A further object of the present invention is to provide a partition structure or assembly of the character described which consists of a small number of easily manufactured and readily assembled elements.

Yet another object of the present invention is to provide a partition structure which is relatively simple and inexpensive to manufacture.

In accordance with an aspect of the present invention a partition structure adapted to form a flush movable wall includes a generally vertical support post having a plurality of sides and at least one partition panel secured thereto. This panel has an edge portion which is located in parallel spaced alignment with one side of the post to define a cavity therebetween. An elongated bracket support strip is located in this cavity with the support strip secured to one side of the post. This strip has a plurality of vertically spaced embossments of predetermined configuration formed thereon extending outwardly of the strip towards the post. These embossments each have a top flat horizontal surface portion and a rear flat vertical surface portion extending downwardly from the top surface and defining an inverted L-shaped bearing surface for engaging L-shaped tabs on a bracket inserted into the cavity.

A support bracket having a plurality of L-shaped tabs extending therefrom for insertion in the cavity and support on the embossments is also provided. The tabs of the bracket include a first leg extending generally perpendicularly therefrom and a second leg spaced from the bracket and extending perpendicularly from the first leg. The embossments are vertically spaced from each other to define slots therebetween having a height which is substantially equal to the sum of the thickness of the first tab and the height of the second tab leg whereby the tabs are readily inserted in the cavity between the post and panel edge through these slots for rigidly supporting the brackets on the embossments.

The above, and other objects, features and advantages of this invention will be apparent in the following detailed description of an illustrative embodiment thereof, which is to be read in connection with the accompanying drawings, wherein:

FIG. 3 is a sectional view taken along line 3—3 of FIG. 2 and showing a bracket mounted on the post;

FIG. 4 is a sectional view taken along line 4—4 of FIG. 3;

FIG. 5 is a sectional view taken along line 5—5 of FIG. 3;

Figure 1:
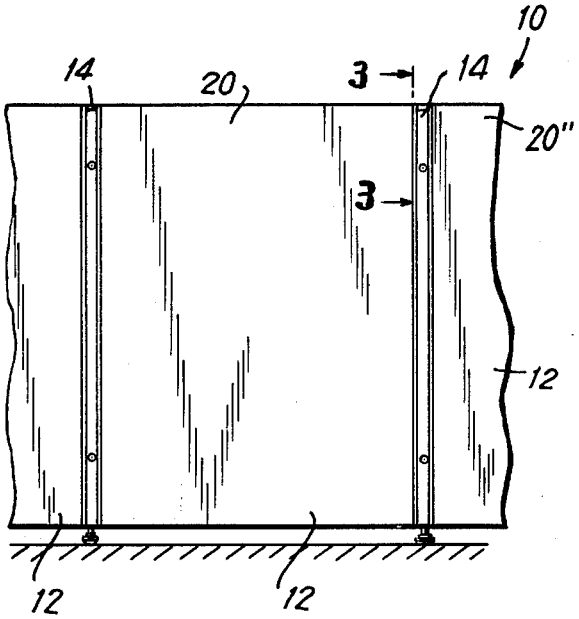
FIG. 1 is an elevational view of a post and panel arrangement for a partition structure constructed in accordance with the present invention.

Referring now to the drawings in detail, and initially to FIG. 1 thereof, a movable partition assembly 10, constructed in accordance with the present invention, is shown as being formed from a series of wall panels 12 connected between vertically extending support posts 14. The panels and posts are readily assembled and disassembled, as described hereinafter, in order to permit the partition arrangement to be varied as desired, and when necessary. The support posts 14 are provided with support bracket structures, also described hereinafter in detail, which provide mounting support for brackets 16 (FIG. 3) of the type which will support shelves across a wall panel, or cabinet brackets 18 (FIG. 7) for securing a cabinet to the wall.

Figure 2:
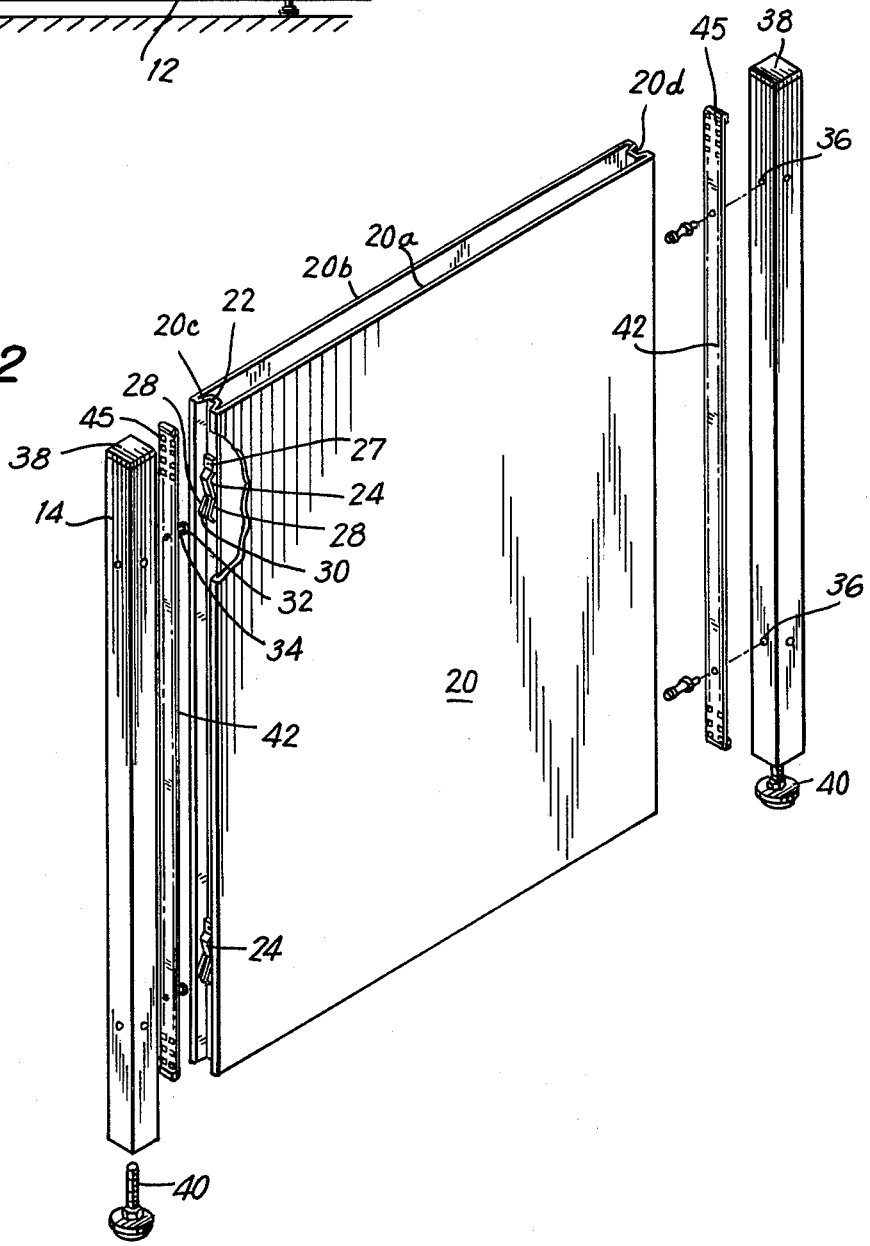
FIG. 2 is an exploded perspective view of the post and panel arrangement of FIG. 1.

Each panel 12 is formed in any well known manner from sheet metal and is of a construction which is commercially available. The panel is formed to have two sides 20*a*, 20*b* and a pair of opposed vertical edges 20*c*, 20*d* which are recessed in a truncated V shape, as seen in FIG. 2 and 5, to define a vertical notch 22. A pair of spring clips 24 are secured to the base wall 26 of notches 22 in vertically spaced relation to each other by rivets, screws 27 or the like, in the conventional manner. These clips have bent leg portions 28 defining slots 30 therebetween. These slots are adapted to receive the heads 32 of bolts 34 secured in posts 14 to lock the panel to the posts. In the conventional procedure bolts 34 are screwed into holes 36 in posts 14 and the panel is slid vertically downwardly as the bolt heads 32 are guided into slots 30 behind the leg portion 28 of the clips, thereby securing the panel to the posts.

Post 14, in the illustrative embodiment, is formed in any convenient and conventional manner from sheet metal and generally are hollow members, square in section. The hollow upper end of the posts are preferably closed by caps 38 and the lower ends are provided with screw type leveling feet 40.

The posts 14 adjacent the edges 20*c*, 20 *d* of panels 20 are provided with bracket support elements or strips 42, each of which consists of a metal strip (preferably 14 gauge steel). These strips have holes 43 formed therein located to be in alignment with the holes 36 in posts 14 to receive the bolts 34. The strips 42 are secured to the posts by bolts 36 before the panel is secured to the post by the spring clips 24. In the assembled partition construction the bracket support strips 42 are located in the cavity 44 (see FIGS. 4 and 5) formed between the adjacent surface of the post and the edge of the panel.

The bracket support strips 42 are each embossed or cold stamped or punched along their vertical length to form a plurality of vertically aligned embossments 45 (see FIGS. 3 and 6) along their length. (The word embossment as used herein is intended to include stamping and punching operations). These embossments are formed to extend away from the adjacent panel edge into the cavity 44 formed between the post and the edge portion of the panel.

Figure 6:
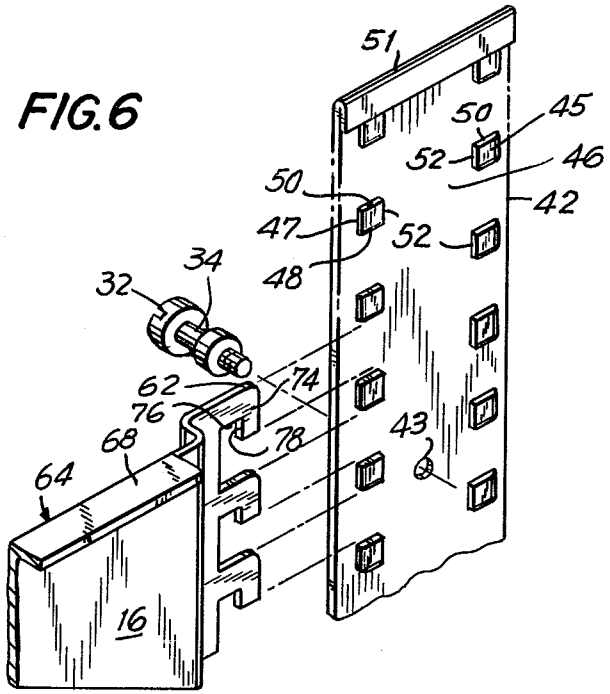
FIG. 6 is a partial exploded perspective view of a shelf bracket and its associsted support strip.

As seen most clearly in FIGS. 3 and 6, embossments 45 are integrally formed with strip 42 along the face 46 thereof and they are formed with a very specific peripheral configuration. In particular, the embossments are cold struck or punched such that their forward edge 47 and their bottom edge 48 are rounded and curved outwardly, remaining integral with strip 42. On the other hand the upper edge 50 and the rear end 52 thereof are formed as relatively flat straight edges which are either integral with strip 42 or cut and spaced slightly therefrom, as seen in FIG. 5. In this manner, embossments 45 provide a generally inverted L-shaped bearing surface which are adapted to receive and engage the generally complementary tabs 62 on the rear edge of a shelf or cabinet support bracket. For example, as seen in FIG. 6, a shelf bracket 64 is illustrated which consists of a flat plate having tabs 62 formed at its rear end, and a horizontally turned flange 68 on which a flat shelf 69 (see FIG. 3) can be supported and secured. The brackets are of lightweight construction and are formed from sheet metal, similar to the sheet metal forming panels 20.

In one specific embodiment of the present invention it is preferred that vertical post elements 14 be formed from 16 gauge steel, with bracket element 64 also being formed of 16 gauge steel. Thus, when embossments 45 are struck from the 14 gauge steel strips 42, the flat faces 50, 52 thereof will extend beyond the side of the strip 42 through a dimension which will be equal to or slightly greater than the thickness of 16 gauge steel, but which will be slightly less than the thickness of 14 gauge steel. Accordingly, when the edge of the panel is clamped tightly against strips 42, by the engagement of bolt heads 34 in clips 24, the cavity 44 formed between the posts and the panel will have a width which is approximately equal to twice the thickness of strips 42. The slots 50 formed between the post and the strip 42, as a result of the presence of embossments 45 will have sufficient width to accept tabs 62. In addition the cavity 44 is sufficiently wide to enable the top end 51 of strip 42 to be bent over on itself, as seen in FIG. 4 to be flush with the cap 38 on post 14 and the cap 38 provided on the top edge of the panel. As a result a smooth, safe, continuous surface is provided on the panel.

Embossments 45 are spaced from each other in a vertical direction so as to define openings therebetween which are dimensioned to receive tabs 62 of bracket 64 therethrough. This permits the L-shaped tabs to be inserted directly into cavity 44 through the slots 50 and openings 70 with the brackets in a horizontal position. The vertical leg portion 74 of each of tabs 62 is dimensioned to be slightly smaller than the openings 70 so that the tab's leg can be readily inserted through the slot.

It will be appreciated therefore that upon insertion of tabs 62 into cavity 44 between openings 70, the tabs will move downwardly slightly as the tab leg 74 passes embossments 45. In this manner the bracket is vertically supported on the embossments 45 and held against inadvertent removal by the cooperation between the bearing surfaces 50, 52 of the embossment and the cooperating surfaces 76, 78 on L-shaped tabs 62. Moreover the brackets are supported against lateral movement since the tabs 62 are, in effect, sandwiched between the strip 42 and the adjacent side of the post. It is noted that the support arrangement for the bracket 62 in accordance with the present invention is relatively strong since the embossments can be made relatively wide, in a front to back direction, with the surfaces 47, 48 connecting the embossments to the post having relatively large dimensions, so that substantial strength for supporting the brackets is provided.

In order to provide additional bearing support for the brackets, the brackets can be bent, as shown in FIG. 5, so that tabs 62 and the major portion 62' of the bracket 64 extend in parallel longitudinal directions, but in spaced offset relation to each other. These sections of the bracket are interconnected by a web portion 78', extending perpendicularly thereto and integrally formed therewith. This offset web is adapted to bear against the adjacent panel 20, as seen in FIG. 5, when tabs 62 are mounted on embossments 45. By this arrangement, while substantially all the weight of the brackets and anything mounted thereon is supported on embossments 45, some additional support is provided to the brackets by the engagement between the webs 78' of the brackets and the panels 20.

Figure 7:
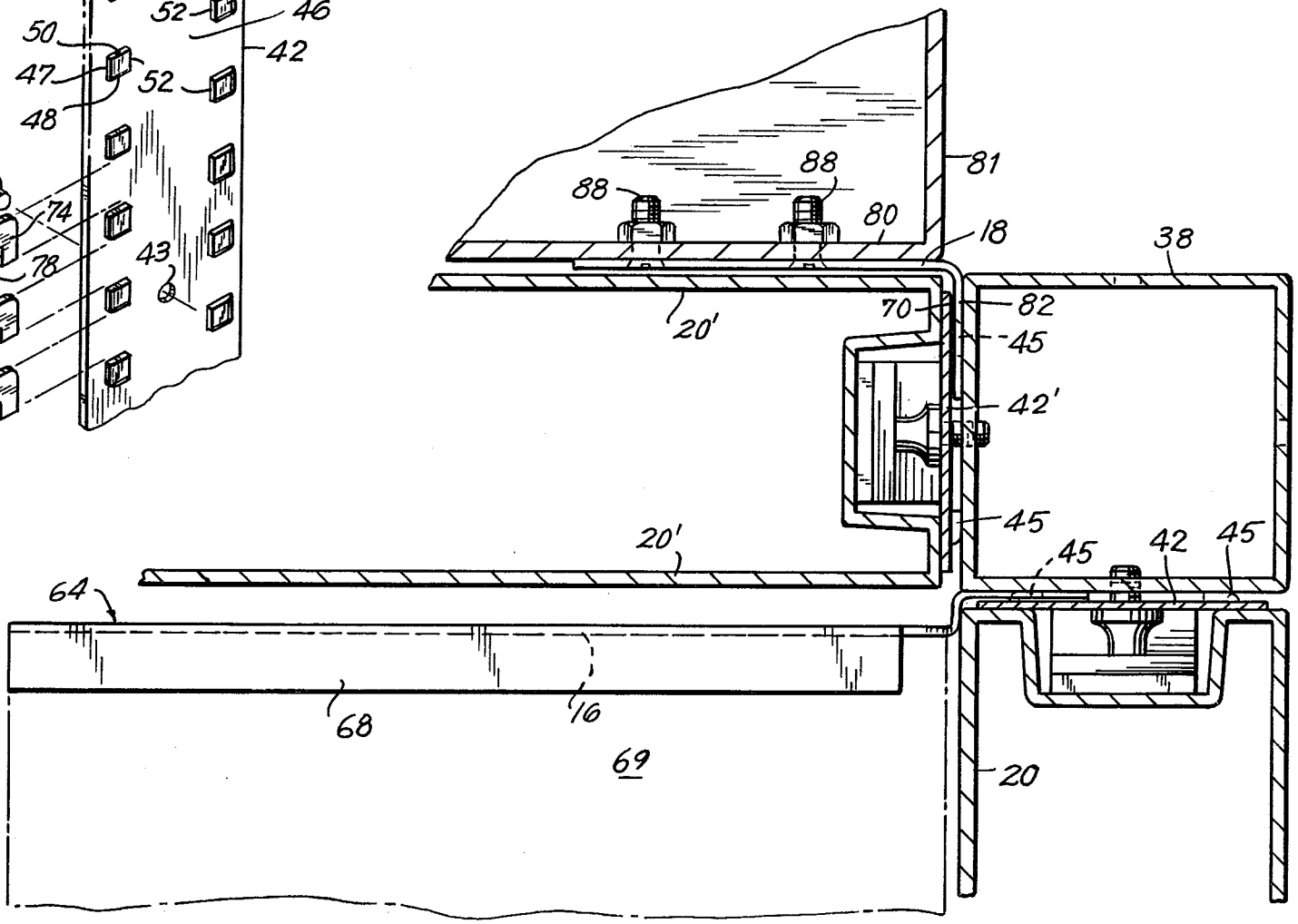
FIG. 7 is an enlarged sectional view, in plan, of a post and panel arrangement for a partition structure constructed in accordance with the present invention.

Another advantageous bracket construction 18 for use with cabinets, is shown in FIG. 7, adjacent a panel 20' extending perpendicularly to panel 20. Bracket 18, has a generally L-shaped configuration including a short leg 82 having L-shaped tabs 62 formed therein. The long leg of the bracket 18 is secured to the back wall 80 of a cabinet 81 by a plurality of screws 88 or the like. The tabs 62 formed on leg 82 are inserted in the openings 70 between the embossments 45 formed on a strip 42' secured to the side of post 14 adjacent and perpendicular to the first strip 42. These embossments are formed on strip 42' in the same manner as those embossments previously described.

By the construction of the invention illustrated in FIG. 1, it will be appreciated that a shelf or cabinet bracket support can be inserted in any one of the cavities 44 formed between a vertical post element 14 and an adjacent panel 20. Thus, a shelf bracket 16, as seen in FIG. 7, has its inner end inserted within the cavity between the post and the adjacent vertical strip 42 on the post. The shelf 69 extends along the panel plate 20 and a similar bracket 16 on its opposite end is mounted in a corresponding cavity 44 formed between the opposite ends of the panel 20 and the next post in the partition assembly. In this manner the edge of the shelf 69 can abut the panel plate 20' which extends at 90° to the panel plate 20 and completely covers the inside corner formed between the two panels at this post 14. This enables the shelf to extend along the entire length of the wall provided by the plate 20 and forms a neat and pleasing appearance for the shelf construction.

Similarly cabinet 81 mounted on post 14, as seen in FIG. 7, has the end of its bracket 18 mounted in the cavity 44 between the edge portion of the panel plate 20' and its adjacent vertical post element 14. Again the cabinet encompasses the entire inside corner between the panels, providing a neat and pleasing appearance for the partition construction.

Since each post can have two bracket support strips 42 mounted on its opposite sides, a series of shelves or cabinets can be mounted along the wall formed by the partition assembly with each shelf or cabinet being at the same elevation. For example, if the shelves were to be mounted along the panels 20, 20'', of the partition construction illustrated in FIG. 1, the shelves could be mounted along the adjacent panels at the same elvation since one set of embossments 45 is available on each of the opposite sides of post 14. Accordingly shelves would be supported in the same level on the same post and extend along adjacent panel elements. Such an arrangement would not be possible with many of the prior constructions for partition structures.

Accordingly, it will be seen that a relatively simply constructed cabinet partition structure is provided which is economical to manufacture, and consists primarily of elements which are already available in the post structure. Accordingly less metal is required, with the result that the structure is less expensive to manufacture. In addition, because embossments 45 are set back from the front face of the panel structure, when the post and panel assembly is spray painted, any paint which might enter cavity 44 and reach surfaces 47 will not be visible when the completed panel construction is viewed head on. In addition, any paint entering into slots 70 will close any openings formed between surfaces 50, 52 of the embossments and the side face of the strips 42, to prevent sound transmission through those openings.

In addition, the strips 42 may be reversed from the position shown in the drawing, if desired, so that the embossments 45 extend toward the panel edges rather than towards the post.

Although an illustrative embodiment of the present invention has been described herein with reference to the accompanying drawings, it is to be understood that the invention is not limited to that precise embodiment, and that various changes or modifications can be effected therein by one skilled in the art without departing from the scope or spirit of this invention.

What is claimed is:

1. A partition structure including a support post having a plurality of vertical sides and a partition panel secured to one of said sides, said panel having an edge portion located in parallel, closely spaced alignment with one side of the post to define a thin cavity therebetween, and a single flat elongated bracket support strip located in said cavity and secured to one side of the post, said strip having a plurality of vertically spaced embossments of predetermined configuration formed thereon and projecting from only one side of the strip, and a support bracket having an inner edge portion including a plurality of spaced mounting tabs formed thereon, said mounting tabs being spaced from each other at regular intervals selected to enter said cavity between said embossments and having an edge configuration selected to mate with at least a portion of the predetermined configuration of said embossments; said post and panel defining an open slot therebetween permitting access into said cavity and said embossments each having a first relatively flat surface portion extending perpendicularly to said slot and a second relatively flat surface portion extending generally perpendicularly to the first surface portion, said first and second flat surface portions defining a generally L-shaped bearing surface and said edge configuration of said tab having a complementary L-shaped configuration.

2. A partition structure including a support post having a plurality of vertical sides and a partition panel secured to one of said sides, said panel having an edge portion located in parallel, closely spaced alignment with one side of the post to define a thin cavity therebetween, and a single flat elongated bracket support strip located in said cavity and secured to one side of the post, said strip having a plurality of vertically spaced embossments of predetermined configuration formed thereon projecting from one side thereof, and a support bracket having an inner edge portion including a plurality of spaced mounting tabs formed thereon, said mounting tabs being spaced from each other at regular intervals selected to enter said cavity between said embossments and having an edge configuration selected to mate with at least a portion of the predetermined configuration of said embossments; said post and panel defining an open slot therebetween permitting access into said cavity and said embossments each having a first relatively flat surface portion extending perpendicularly to said slot and a second relatively flat surface portion extending generally perpendicularly to the first surface portion, said first and second surface portions defining a generally inverted L-shaped bearing surface and said edge configuration of said tab having a complementary inverted L-shaped configuration.

3. A partition structure as defined in claim 2 wherein the width of said embossments is substantially equal to the width of said strip.

4. A partition structure as defined in claim 3 wherein the width of said tabs is slightly less than the width of said embossments.

5. A partition structure as defined in claim 4 wherein said one side of the post and said bracket are formed of sheet metal.

6. A partition structure as defined in claim 2 wherein said tabs each include a first leg extending generally perpendicularly from the bracket and a second leg spaced from the bracket and extending perpendicularly to the first leg.

7. A partition structure as defined in claim 6 including means for simultaneously and releasably securing both said panel and said strip to said post.

8. A partition structure including a vertical support post and a first partition panel secured thereto, said first panel having an edge portion which is located in parallel spaced alignment with said post to define a thin cavity therebetween, and a single flat elongated bracket support strip located in said cavity and secured to the post, said strip having a plurality of vertically spaced embossments of predetermined configuration formed thereon projecting from one side thereof, said embossments each having a top flat horizontal surface portion and a rear flat vertical surface portion extending downwardly from said top surface and defining an inverted L-shaped bearing surface, for engaging the L-shaped tabs of a bracket inserted into said cavity; a support bracket having a plurality of L-shaped tabs extending therefrom for insertion in said cavity and support on said embossments, said tabs each including a first leg extending generally perpendicularly therefrom and a second leg spaced from the bracket and extending perpendicularly from the first leg; said embossments being spaced vertically from each other to define slots therebetween having a height which is substantially equal to the sum of the thickness of the first tab leg and the height of the second tab leg whereby the tabs are readily inserted in said cavity through said slots for rigidly supporting the bracket on the embossments.

9. A partition structure including a vertical support post and a first partition panel secured thereto, said first panel having an edge portion which is located in parallel spaced alignment with said post to define a thin cavity therebetween, and a single flat elongated bracket support strip located in said cavity and secured the post, said strip having a plurality of vertically spaced embossments of predetermined configuration formed thereon projecting only from one side thereof, said embossments each having a top flat horizontal surface portion and a rear flat vertical surface portion extending downwardly from said top surface and defining an inverted L-shaped bearing surface, for engaging the L-shaped tabs of a bracket inserted into said cavity; a support bracket having a plurality of L-shaped tabs extending therefrom for insertion in said cavity and support on said embossments, said tabs each including a first leg extending generally perpendicularly therefrom and a second leg spaced from the bracket and extending perpendicularly from the first leg; said embossments being spaced vertically from each other to define slots therebetween having a height which is substantially equal to the sum of the thickness of the first tab leg and the height of the second tab leg whereby the tabs are readily inserted in said cavity through said slots for rigidly supporting the bracket on the embossments; and a second panel substantially identical to the first panel and secured to the post to extend therefrom at approximately 90° from said first mentioned panel whereby said cavity remains exposed to receive the tab or bracket therein.

10. A partition structure including a vertical support post having a plurality of sides and a first partition panel secured thereto, said first panel having an edge portion which is located in parallel spaced alignment with one side of said post to define a thin cavity therebetween, and a single flat elongated bracket support strip located in said cavity and secured to said one side of the post, said strip having a plurality of vertically spaced embossments of predetermined configuration formed thereon extending outwardly of said on only one side thereof, said embossments each having a top flat horizontal surface portion and a rear flat vertical surface portion extending downwardly from said top surface and defining an inverted L-shaped bearing surface, for engaging the L-shaped tabs of a bracket inserted into said cavity.

11. A partition structure as defined in claim 10 wherein said post includes a second vertical side extending generally perpendicularly to said one side of the post and located adjacent to said cavity leaving said cavity exposed for insertion of a bracket therein.

12. A partition structure as defined in claim 11 including means for simultaneously and releasably securing both said panel and said strip to said post.

* * * * *